US006024058A

United States Patent [19]

Burnett

[11] Patent Number: 6,024,058

[45] Date of Patent: Feb. 15, 2000

[54] BLOWBY OIL SEPARATOR AND RESERVOIR DEVICE

[76] Inventor: Darren W. Burnett, Design International Inc., 6400 Echo Hill Dr., Evansville, Ind. 47720

[21] Appl. No.: 09/225,209

[22] Filed: Jan. 4, 1999

[51] Int. Cl.[7] ..... F01M 13/00

[52] U.S. Cl. ..... 123/41.86

[58] Field of Search ..... 123/41.86, 572, 123/573, 574

[56] References Cited

U.S. PATENT DOCUMENTS

| | | | |
|---|---|---|---|
| 2,849,994 | 9/1958 | Barker | 123/41.86 |
| 4,156,406 | 5/1979 | Brandau et al. . | |
| 4,501,234 | 2/1985 | Toki et al. | 123/41.86 |
| 4,502,424 | 3/1985 | Katoh et al. | 123/41.86 |
| 4,602,595 | 7/1986 | Aoki et al. . | |
| 4,607,604 | 8/1986 | Kanoh et al. . | |
| 4,723,529 | 2/1988 | Yokoi et al. . | |
| 5,239,972 | 8/1993 | Takeyama et al. | 123/41.86 |
| 5,277,154 | 1/1994 | McDowell | 123/41.86 |
| 5,355,860 | 10/1994 | Ekstam . | |
| 5,534,138 | 7/1996 | Coale . | |
| 5,562,087 | 10/1996 | Wright . | |
| 5,617,834 | 4/1997 | Lohr . | |
| 5,730,106 | 3/1998 | Gonzalez . | |
| 5,803,025 | 9/1998 | Feucht | 123/41.86 |

*Primary Examiner*—Marguerite McMahon
*Attorney, Agent, or Firm*—Richard C. Litman

[57] ABSTRACT

An economical and effective blowby oil separator and reservoir device in a retrofitting kit for adding to an internal combustion engine.

7 Claims, 1 Drawing Sheet

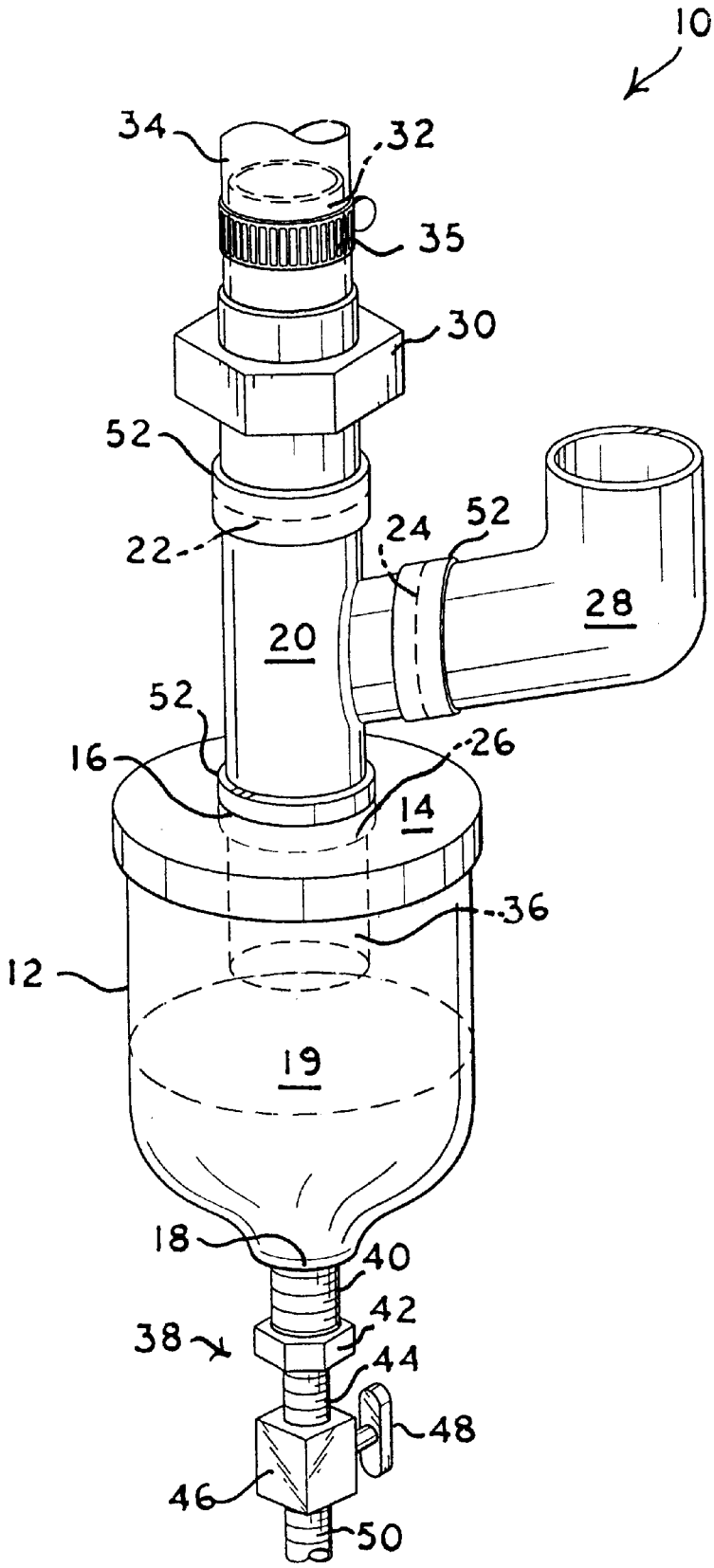
10
34
32
35
30
52
22
24
52
28
20
52
16
26
14
36
12
19
18
40
42
38
44
48
46
50

BLOWBY OIL SEPARATOR AND RESERVOIR DEVICE

BACKGROUND OF THE INVENTION

1. Field of the Invention

The present invention relates to a blowby oil separator and reservoir device for separating gas from the liquid before recycling the blowby oil to the oil reservoir of a diesel engine.

2. Description of the Related Art

The related art of interest describes various large and intricate apparatus for separating the phases of the oil and gas mixture emitted from an internal combustion engine. None of the related art disclose the economical and effective device of the present invention. The related art will be discussed in the order of perceived relevance to the present invention.

U.S. Pat. No. 5,730,106 issued on Mar. 24, 1998, to Jose M. Gonzalez describes a fuel/vapor separator apparatus for diesel engines involving a connection of the separation canister to the diesel fuel filter cartridge and a valving arrangement for a cartridge change. The separation canister receives the mixture from the fuel tank and includes a vertical inlet tube feeding the vapor-liquid mixture to an upper metal screen element which agitates the mixture to cause the vapor to exit from the top and the liquid to exit from the bottom through a second screen to the diesel fuel engine. The separator apparatus is distinguishable for its direct connection to the diesel engine's fuel filter, receiving the gas/fuel oil mixture from the fuel tank (not blowby mixture) and the requirement of multiple screens. The prior art problems elucidated by Gonzalez are incorporated by reference.

U.S. Pat. No. 5,355,860 issued on Oct. 18, 1994, to Charles L. Ekstam describes a fuel delivery system for diesel engines requiring a water separation filter, a fuel pump, a particulate filter, a regulator valve, and an air filter processing the fuel mixture in the order named. The numerous elements required distinguish this fuel delivery system.

U.S. Pat. No. 4,602,595 issued on Jul. 29, 1986, to Kongoh Aoki et al. describes a lubricating oil separator located inside the cylinder head cover of an internal combustion engine. A vertically arranged foam metal filter collects the blowby mixture on the effluent side to drip into an oil reservoir which communicates with the upper chamber of the cylinder or the crankcase through a bevel check valve. The blowby gas apparently is emitted to the atmosphere or recycled to the crankcase. The lubricating oil separator is distinguishable for being limited to a foam metal filter in a gasoline engine requiring oil lubrication within the cylinders.

U.S. Pat. No. 4,607,604 issued on Aug. 26, 1986, to Junichi Kanoh et al. describes an oil separator for an internal combustion engine similar to the Aoki et al. described above, but with the modification of a relief valve for the oil reservoir. The oil separator is distinguishable for its limitation to a foam metal filter in a gasoline engine for recovery of blowby lubricating oil.

U.S. Pat. No. 4,156,406 issued on May 29, 1979, to Steven G. Brandau et al. describes an internal combustion engine gas-oil separator in the form of a bowl with an open bottom clamped onto each rocker arm cover of a gasoline engine. The separator contains three non-aligned baffles in a stack to obtain sedimentation and impactive precipitation of the oil which seeps back into the rocker arm cover while the exhaust air is vented to the atmosphere or recycled to the crankcase. The separator is distinguishable for its baffled structure.

U.S. Pat. No. 4,723,529 issued on Feb. 9, 1988, to Tatsuhisa Yokoi et al. describes an oil separator inside the cylinder head cover for a blowby gas ventilation system of an internal combustion engine. The blowby gas with lubricating oil is passed through two vertical foam metal filters while the oil collects in two grooves provided adjacent the filters. The cleaned exhaust gas is recycled to the crankcase or vented to the atmosphere. The oil separator is distinguishable for its limitation to the cylinder head cover.

U.S. Pat. No. 5,534,138 issued on Jul. 9, 1996, to Christopher F. Coale describes a horizontally disposed cylindrical fuel separator apparatus positioned between a diesel fuel tank and a filter and pump leading to the diesel engine. The contaminated fuel is fed into a frustoconical centrifugation portion which separates the fuel raffinate (top) from the contaminants (bottom). An extract level sensor and a heat probe are added to the fuel separator housing. The fuel separator is distinguishable for its unique centrifugation means.

U.S. Pat. No. 5,562,087 issued on Oct. 8, 1996, to Richard T. Wright describes an oil separator for blowby gases of a diesel engine, wherein the cleaned gases can be recycled or emitted to the atmosphere. A housing of various forms contains an apertured nozzle element spaced above an impingement plate to collect the oil droplets which pass through the bottom drain while the cleaned gases pass through a circuitous route to be either recycled into the air system of a closed system or exhausted into the atmosphere. The oil separator is distinguishable for its apertured nozzle element and the impingement plate.

U.S. Pat. No. 5,617,834 issued on Apr. 8, 1997, to John C. Lohr describes an air-oil separator for a crankcase ventilation system in an internal combustion engine. The housing is attached to the top of the engine and has an inlet consisting of two inlet tubes for receiving the blowby gases from the engine and causing the gases to swirl. The swirling effect causes some of the lubricating oil to collect within the tubes and fall back into the engine. The outlet for the gases is positioned near the top of the housing and above the corrugated double-sided baffle apertured at both ends to collect the lubricating oil separating from the gases flowing at a reduced rate. The lubricating oil drains through the apertures into the two inlet tubes and into the engine. The air-oil separator is distinguishable for its doubled and corrugated baffle and the double tube structure.

None of the above inventions and patents, taken either singularly or in combination, is seen to describe the instant invention as claimed. Thus, an economical and effective blowby oil reservoir device for an internal combustion engine is desired.

SUMMARY OF THE INVENTION

The invention is a blowby oil separator and reservoir, including a lidded, a bowl-shaped reservoir with a central aperture in the lid and a bottom outlet port for collecting and separating blowby oil containing gases into a liquid fraction and an effluent gaseous fraction. There is a tee conduit having top, side and bottom openings, and an elbow conduit projecting upward and connected to the side opening of the tee conduit for dispersal of the effluent gaseous fraction. Also, there is an adapter conduit connected to the top opening of the tee conduit for connection to a first conduit carrying blowby oil containing gases, a second conduit connected to the bottom opening of the tee conduit and inserted in the aperture of the lid of the reservoir, and a third conduit having one end attached to the bottom outlet port of the reservoir. Finally, there is a valve attached to an opposite end of the third conduit for manual operation of cutoff or outflow of the collected blowby oil, so that the blowby oil containing gases is separated into liquid and gaseous phases by agitation and cooling.

Accordingly, it is a principal object of the invention to provide an economical and effective blowby oil separator and reservoir device for an internal combustion engine.

It is another object of the invention to provide an economical and effective blowby oil separator and reservoir device for a diesel engine.

It is a further object of the invention to provide an effective and economical blowby oil separator and reservoir device made substantially of plastic and located underneath a diesel engine.

Still another object of the invention is to provide an effective and economical blowby oil separator and reservoir device costing less than $60.00.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The FIGURE is a perspective view of a blowby oil separator and reservoir device for an internal combustion engine according to the present invention.

DETAILED DESCRIPTION OF THE PREFERRED EMBODIMENT

The present invention provides an economical and effective blowby oil separator and reservoir device 10. Although individual elements are depicted, some elements can be combined as one integral unit.

The FIGURE illustrates a blowby oil separator and reservoir device 10 comprising a bowl-shaped reservoir 12 having a large circular lid 14 with a central aperture 16 and a bottom outlet port 18 for collecting and separating blowby oil containing gases into a liquid fraction 19 and an effluent gaseous fraction. A tee conduit 20 has a top opening 22, a side opening 24 and a bottom opening 26. The side opening 24 is connected to an elbow conduit 28 projecting upward for dispersal of the effluent gaseous fraction either into the ambient atmosphere or recycled into the engine.

An adapter conduit 30 is vertically connected to the top opening 22 of the tee conduit 20 for connection to a first conduit 32. A conventional blowby oil hose 34 carrying the blowby oil containing gases from the diesel engine is connected to the first conduit 32 by a hose clamp 35. A second conduit 36 is connected to the bottom opening 26 of the tee conduit 20 and inserted in the aperture 16 of the lid 14. A third conduit 38 has one end, pipe 40, attached to the bottom outlet port 18 of the reservoir 12. The opposite end of pipe 40 is attached to a brass reducer element 42 which is connected to a pipe 44 having a reduced diameter. The pipe 44 is connected to a brass valve element 46 having a valve handle 48 for manual operation in the cutoff or outflow of the collected blowby oil devoid of gases. A plastic or metal threaded pipe 50 connected to the valve element 46 recycles the gas depleted diesel oil back to the engine. The third conduit 38 has been depicted as a combination of two threaded plastic pipes 40 and 44 joined by a brass reducer element 42. However, the third conduit 38 can alternatively be a single unit.

The FIGURE shows three plastic connector collars 52 for joining the plastic adapter conduit 28 to the top opening 22 of the plastic tee conduit 20, joining the side opening 24 of the tee conduit to the plastic elbow conduit 30, and joining the bottom opening 26 of the tee conduit to the plastic second conduit 36 and the lid 14. The joints are sealed with an adhesive for the polyvinyl chloride pipes and collars 48.

The vertically disposed reservoir 12 can conveniently be translucent to enable visual inspection of the level of the recovered diesel fuel in the reservoir. It has been observed that the size of the reservoir 12 can be 20 fluid ounces and serve adequately. The diameters of the piping upstream from the reservoir 12 can be 0.75 in. O.D. with the collars 52 being 1.125 in. O.D. The pipes 40 and 44 of the downstream third conduit 38 can be reduced from 0.375 in. to 0.25 in. O.D. to connect to the brass valve 46.

Since the device 10 is made of predominantly polyvinyl chloride plastic, the tee conduit 20 and the elbow conduit 28 can conveniently be made as one unit. Furthermore, the adapter conduit 30, the tee conduit 20, the second conduit 36, the elbow conduit 28, the third conduit 38, and the removable threaded lid 14 can be formed as one integral unit of polyvinyl alcohol plastic.

The blowby oil separator and reservoir device 10 can be supplied as a kit to retrofit existing diesel engines or added initially to diesel engines during manufacture.

Thus, an economical and efficient blowby oil separator and reservoir device 10 in kit form has been shown, whereby the blowby oil containing gases are separated into the liquid and gaseous phases by agitation and cooling.

It is to be understood that the present invention is not limited to the embodiment described above, but encompasses any and all embodiments within the scope of the following claims.

I claim:

1. A blowby oil separator and reservoir device comprising:

a bowl-shaped reservoir having a large circular lid with a central aperture and a bottom outlet port for collecting and separating blowby oil containing gases into a liquid fraction and an effluent gaseous fraction;

a tee conduit having a top opening, a side opening and a bottom opening;

an elbow conduit projecting upward and connected to the side opening of the tee conduit for dispersal of the effluent gaseous fraction;

an adapter conduit connected to the top opening of the tee conduit for connection to a first conduit carrying blowby oil containing gases;

a second conduit connected to the bottom opening of the tee conduit and inserted in the aperture of the lid of the bowl-shaped reservoir;

a third conduit having one end attached to the bottom outlet port of the bowl-shaped reservoir; and a valve attached to an opposite end of the third conduit for manual operation of cutoff or outflow of the collected blowby oil;

whereby the blowby oil containing gases are separated into liquid and gaseous phases by agitation and cooling.

2. The blowby separator and reservoir device according to claim 1, wherein the device is located underneath the engine adjacent to the oil pan, whereby the device can be cooled by the ambient air to enhance the separation effect.

3. The blowby separator and reservoir device according to claim 1, including a removable lid for the reservoir.

4. The blowby separator and reservoir device according to claim 1, wherein the device is in the form of a kit for retrofitting a diesel engine.

5. The blowby separator and reservoir device according to claim 1, wherein the tee conduit and the elbow conduit are formed as one unit of plastic.

6. The blowby separator and reservoir device according to claim 1, wherein the adapter conduit, the tee conduit, the second conduit, the elbow conduit, the third conduit, and a removable lid for the reservoir are formed as one unit of plastic.

7. The blowby separator and reservoir device according to claim 1, wherein the reservoir and a removable lid for the reservoir are threaded and made of plastic.

* * * * *